United States Patent [19]

Finke

[11] Patent Number: 4,475,885

[45] Date of Patent: Oct. 9, 1984

[54] ADJUSTABLE FLAME BURNER

[75] Inventor: Harry P. Finke, Pittsburgh, Pa.

[73] Assignee: Bloom Engineering Company, Inc., Pittsburgh, Pa.

[21] Appl. No.: 518,079

[22] Filed: Jul. 28, 1983

[51] Int. Cl.[3] ..... F23M 9/00; F23Q 9/00

[52] U.S. Cl. ..... 431/182; 431/284; 431/188; 431/187; 239/424; 239/428; 239/433

[58] Field of Search ..... 431/185, 350, 188, 182, 431/187, 284, 285; 239/405, 406, 428, 434.5, 433, 424; 60/29.8, 39.7; 110/263, 264, 265

[56] References Cited

U.S. PATENT DOCUMENTS

| | | | |
|---|---|---|---|
| 2,287,057 | 6/1942 | Page | 431/188 X |
| 2,992,531 | 7/1961 | Hershey | 431/284 X |
| 3,418,062 | 12/1968 | Hovis et al. | 431/350 |
| 4,105,163 | 8/1978 | Davis, Jr. et al. | 239/406 |

FOREIGN PATENT DOCUMENTS

| | | | |
|---|---|---|---|
| 172755 | 12/1921 | United Kingdom | 431/187 |

*Primary Examiner*—Randall L. Green

*Attorney, Agent, or Firm*—Webb, Burden, Robinson & Webb

[57] ABSTRACT

An adjustable flame burner for an industrial furnace comprises a burner body having a baffle with a discharge face forming a forward wall thereof. A first set of space combustion sustaining gas apertures extend axially through the baffle and a second set of apertures also extend axially through the baffle but at an acute angle to the first apertures and also offset from the burner center line in skewed relationship thereto. The apertures of the respective sets intersect at the discharge face and the relative amount of combustion sustaining gas is controlled between the two sets of apertures to provide a tunable, flame release pattern varying between a short cylindrical flame and a long intense all radial flame.

10 Claims, 6 Drawing Figures

ADJUSTABLE FLAME BURNER

FIELD OF THE INVENTION

My invention relates to a burner structure suitable for use in industrial furnaces such as soaking pit and reheat furnaces and more particularly, burner structures of the adjustable flame type.

DESCRIPTION OF THE PRIOR ART

Large industrial furnaces of the metallurgical or other heat treating type require precisely controlled temperature distribution to achieve product quality and/or satisfy subsequent processing operations. In the case of soaking pits for heating steel ingots, burners are normally operated at a maximum rated capacity to bring the ingots up to rolling temperature as fast as possible and thereafter the burners are cut back so as to maintain the proper temperature while the ingots are thermally soaked.

In reheat furnaces, for example side-fired walking beam furnaces, a fixed flame burner simply can not control the temperature distribution since the presence of such furnace conditions as the movement of gases through the furnace, different stock sizes and productivity rates create variable flame requirements.

These problems were recognized in U.S. Pat. No. 3,771,944 of which I am a co-inventor. In that patent, an adjustable flame burner is disclosed which permits adjustment of the flame characteristics under various operating conditions. Another patent which discloses burner structures for soaking pits is U.S. Pat. No. 3,418,062. In that patent a concentric burner structure is disclosed in which a low capacity burner is concentrically mounted within a high capacity burner giving varied, albeit limited options of operation.

While the above two burners have proven quite successful, the need still remains for an improved adjustable flame burner having a wide range of flame characteristics for any given application.

I have now developed such a burner which exceeds the capabilities of previous adjustable flame burners and which has the optional capability of acting as a maintained energy burner as well. My burner will yield a violently short, high release combustion pattern that will either burn in a short cyindrical fashion or break into a high release coanda-type flame having a large flame diameter with effectively zero forward velocity. Alternately, my burner can produce a high intense flame approximately three times as long as the previously described flame and have an essentially zero radical component. My burner is adjustable between these two extreme conditions to provide a wide variety of flame characteristics.

My adjustable flame burner includes a burner body having a baffle with a discharge face forming a forward wall thereof. The fuel duct extends co-axially with the longitudinal axis of the burner and passes through the burner baffle. A first set of spaced combustion sustaining gas apertures extend axially with the burner and radially outward of and parallel to the fuel duct. A second set of radially spaced combustion gas apertures extend through the baffle at an acute angle to the apertures of the first set and intersect with the apertures of the first set at or substantially adjacent the discharge face. The second set of apertures are also offset or skewed with respect to the central burner axis. Means are provided to adjust the relative amount of combustion sustaining gas through the first and second set of apertures. The angle of intersection between the two sets of burners is in the range of 45° to 65° and preferably on the order of 65°. When combined with a port block, the port block should have a length to diameter ratio in the range of 0.7 to 1.5. A third set of air apertures exiting the baffle upstream of the intersection of the first and second set may be employed.

DESCRIPTION OF THE PREFERRED EMBODIMENTS

My adjustable flame burner is applicable to a number of industrial heating furnaces but finds particular application to metallurgical furnaces such as soaking pits and reheat furnaces such as walking beam side-fired furnaces or longitudinally-fired furnaces.

Figure 1:
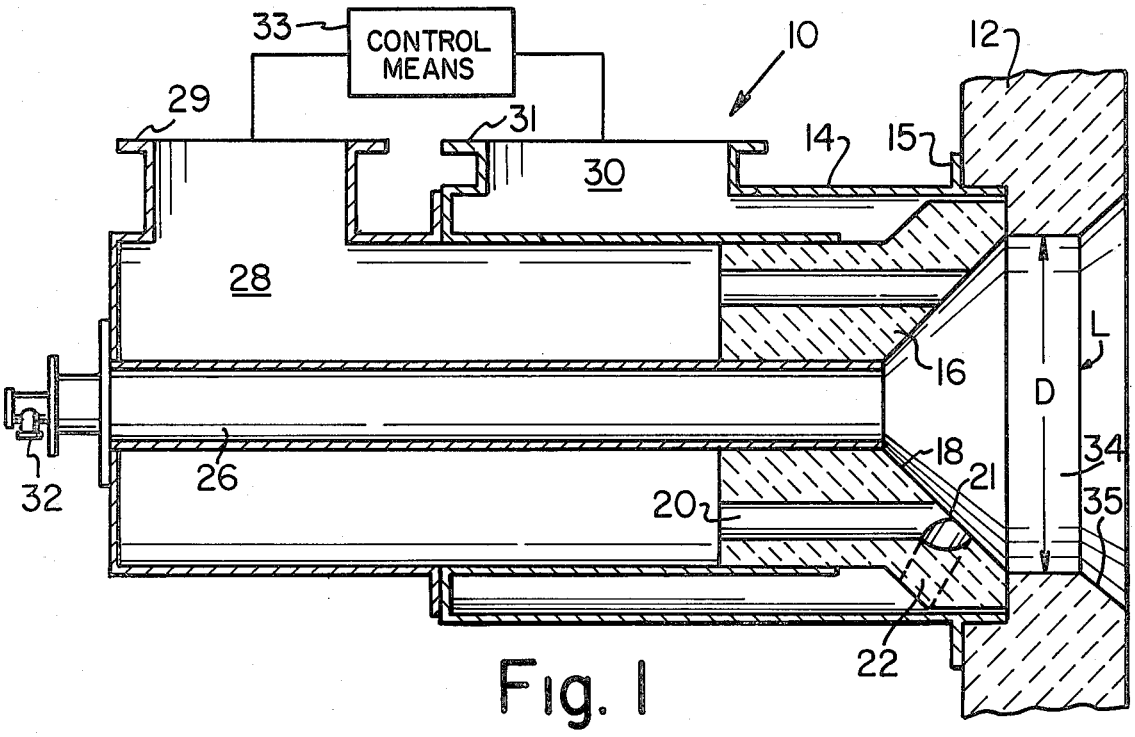
FIG. 1 is a section taken along section lines I—I of FIG. 2 and showing my burner in conjunction with a port block.

The burner, generally designated 10, is mounted to a furnace wall 12 by means of a mounting plate 15 in the conventional manner, FIG. 1. The furnace wall 12 includes an opening aligned with the burner 10 and exiting into the furnace chamber (not shown), which opening is known as port block 34. Port block 34 is cylindrical in shape and has a diameter D and an axial extent L. While port block 34 is normally cylindrical throughout its axial length, it may include a diverging tapered exit way 35 as shown.

Figure 2:
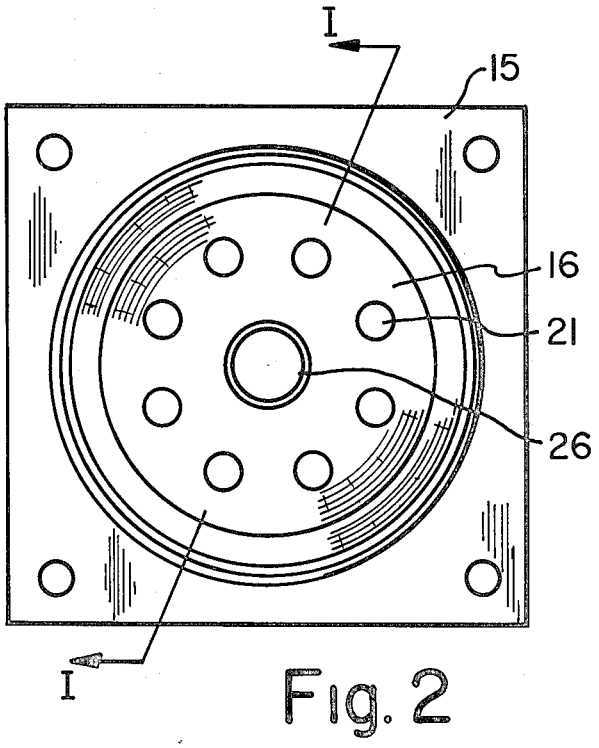
FIG. 2 is an end view of the burner.

The burner 10 includes a burner body 14 having a refractory baffle 16 forming the forward wall thereof, FIGS. 1 and 2. Baffle 16 has a frustoconical shaped discharge face 18 which increases in diameter in the downstream direction. A central fuel duct 26 extends along the burner body central axis, passes through baffle 16 and exits at the upstream end of discharge face 18. Fuel supply fitting 32 connects to fuel duct 26 to provide the appropriate gaseous, liquid or solid fuel, or combinations thereof, the details of which do not form a part of this invention.

Surrounding central fuel duct 26 and within the burner body 14 is air chamber 28 having air inlet 29 for connection to an air source, FIG. 1. The forward wall of chamber 28 is formed of baffle 16. A series of air apertures 20 which are radially disposed about the central burner axis extend through the baffle 16 from the air chamber 28 to the discharge face 18. Air apertures 20 extend substantially parallel with the burner central axis.

A second air chamber 30 is annularly disposed about the first air chamber and is generally positioned partially downstream thereof, FIG. 1. Air chamber 30 has an inlet 31 for connection to an air source. Air chamber 30 also terminates at baffle 16 and a plurality of axial air apertures 22 extend through baffle 16. Air apertures 22 are angularly disposed with respect to air apertures 20 so that each aperture 20 intersects with a corresponding aperture 22 at an acute angle and at or substantially near the discharge face. This angle of intersection is referred to as the spin angle and is generally on the order of 45° to 65° with 65° being preferred. Air apertures 22 are also skewed with respect to the longitudinal center line of the burner so as to produce a swirling air input. In other words, a plane passing through the longitudinal axis of each air aperture 22 also passes through the exit end of an air aperture 20 and such a plane is offset from a plane through the center line of the burner. At the point of intersection of the two apertures, the air through apertures 22 may actually be a diverging or converging spin.

Standard control means 33 can be used to adjust the relative amount of air or other combustion sustaining gas passing through the first set of air passages 20 and the second set of air passages 22, respectively. In addition, automatic control means can vary the heat release pattern over a series of operating conditions. The details of these various controls do not form a part of this invention.

When all of the combustion air is passed through air passages 22, the combination of the spin angle and the offset from the central burner axis produces a rotary or swirling action on the combustion air when the air jet impinges within the burner tunnel or port block. This yields a violently short, high release combustion pattern that will either burn in a short cylindrical fashion or break into the high release coanda-type flame, with the flame diameter increasing substantially with effectively zero forward velocity to flame and products of combustion.

Alternately, when all the combustion air passes through the axial air passages 20 the spin is eliminated and the air is accelerated axially producing a high intense flame approximately three times as long as the flame achieved using the spin angle. Since the two series of air jet coincide at a point substantially at the discharge face, a tunable flame release pattern can thereby be achieved by altering the percentage of air through the respective air passages 20 and 22.

Figure 6:
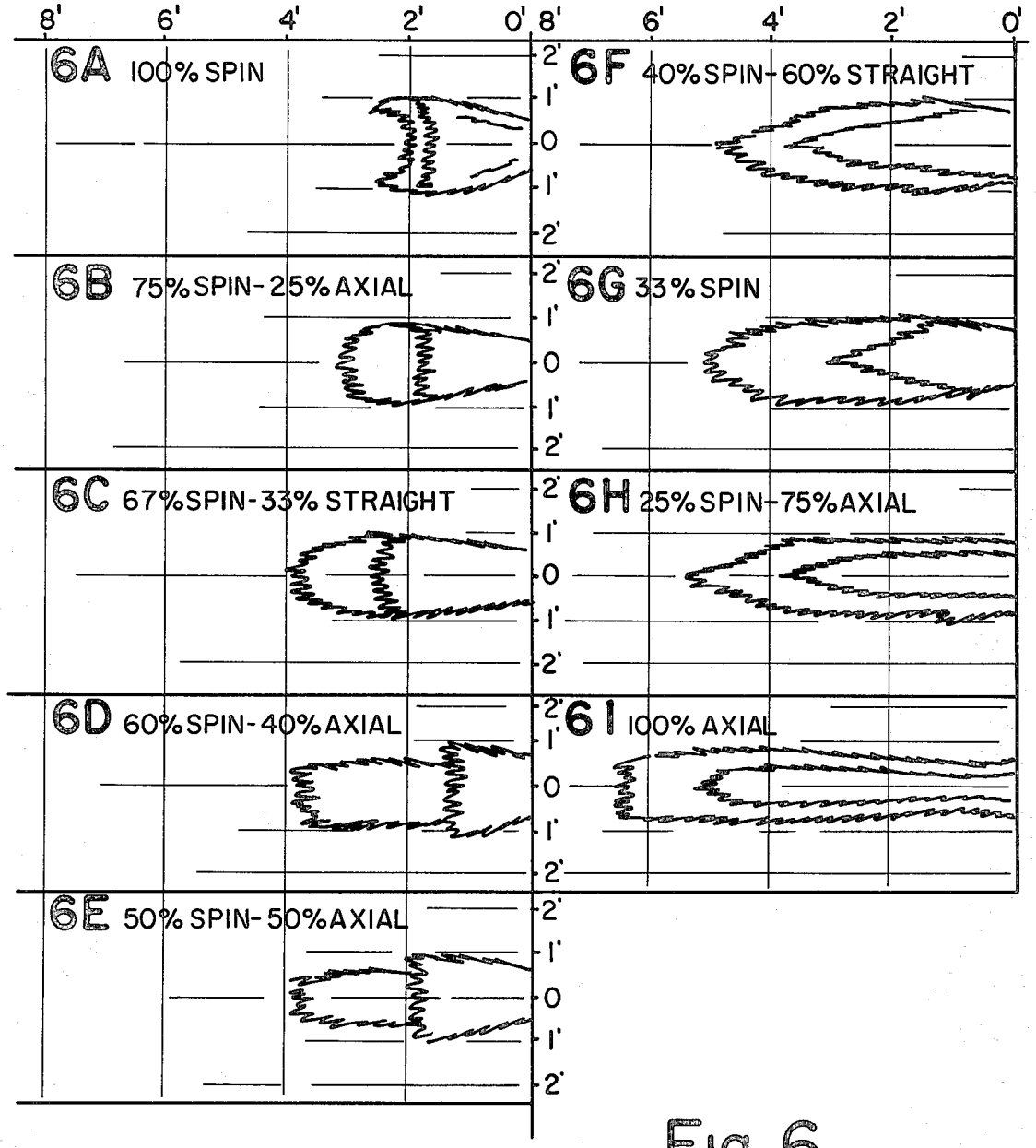
FIG. 6 is a schematic in graph form showing the flame configuration over a range of operating conditions.

A number of flame release patterns achieved by altering the air input between the limits of 100% spin and 100% axial is illustrated in FIG. 6. The operating data for the tests given in Table I.

At 100% spin (FIG. 6A) the flame was about 2½' long and some 2' in diameter. It was blue-violet with blue tails at the exit of the port with no visible color in the port area. At 75% spin and 25% axial flow (FIG. 6B) the flame was 3½' long and 1½' in diameter. The flame color was blue-violet exiting the port with orange tails. At 67% spin and 33% axial flow (FIG. 6C) the flame length was 4' long and 2' in diameter. The flame color exiting the port was violet with hazy orange tails. As the spin was decreased to 60% and the axial flow increased to 40% (FIG. 6D) the overall dimensions of the flame remained about the same except that the flame developed a violet center portion about 1' in diameter and an outer orange ring at the port area. At 50% spin and 50% axial flow (FIG. 6E) the flame length increased to 4½' and the diameter reduced to 1½'. The flame was violet to orange in the center with orange tails about the port area. At 40% spin and 60% axial flow (FIG. 6F) the flame length was 5' long and 1½' in diameter. The flame had a long, blue-violet center with orange tails surrounding the center portion. At 33% spin and 67% axial flow (FIG. 6G) the flame increased to 5½' long and 1½' in diameter. The color and shape were about the same as the preceding flames, except the flame edge became more jagged.

As the spin was further reduced to 25% and the axial flow increased to 75% (FIG. 6H) the flame size and color remained the same as the preceding flame. However, the orange tails became more sharply defined and less jagged.

TABLE I

| TEST NO | NAT. GAS FLOW SCFH | TOTAL AIR SPIN + AXIAL FLOW SCFH | AXIAL AIR FLOW SCFH | FLOW % SPIN:AXIAL | TURN DOWN |
|---|---|---|---|---|---|
| 6A | 7270 | 80,000 | 0 | 100:00 | 1/1 |
| 6B | 7270 | 80,000 | 20,000 | 75:25 | 1/1 |
| 6C | 7270 | 80,000 | 26,700 | 67:33 | 1/1 |
| 6D | 7270 | 80,000 | 32,000 | 60:40 | 1/1 |
| 6E | 7270 | 80,000 | 40,000 | 50:50 | 1/1 |
| 6F | 7270 | 80,000 | 48,000 | 40:60 | 1/1 |
| 6G | 7270 | 80,000 | 53,300 | 33:67 | 1/1 |
| 6H | 7270 | 80,000 | 60,000 | 25:75 | 1/1 |
| 6I | 7270 | 80,000 | 72,000* | 0:100* | 1/1 |

Figure 3:
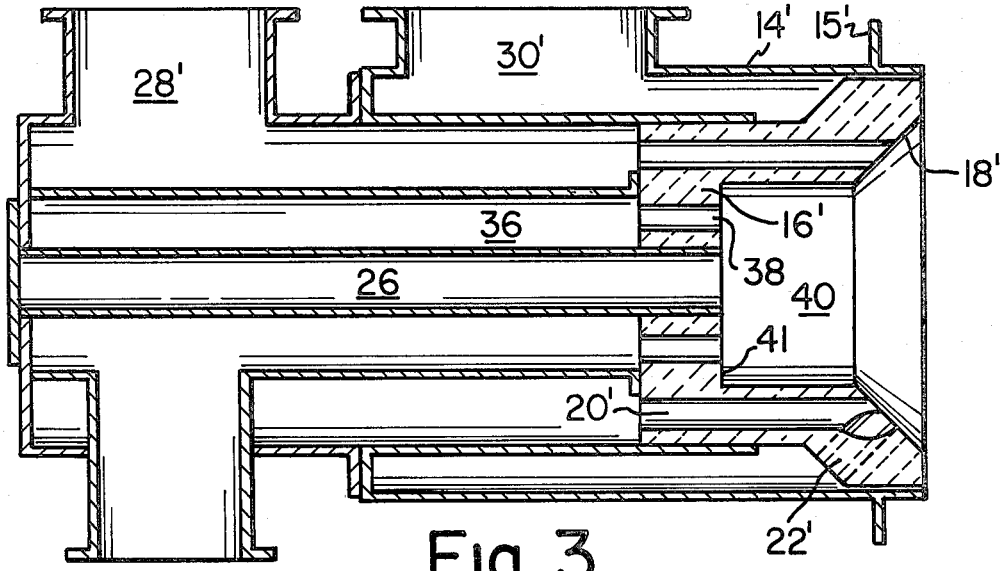
FIG. 3 is a section taken along section lines III—III of FIG. 4 and showing a modified form of the burner.
Figure 4:
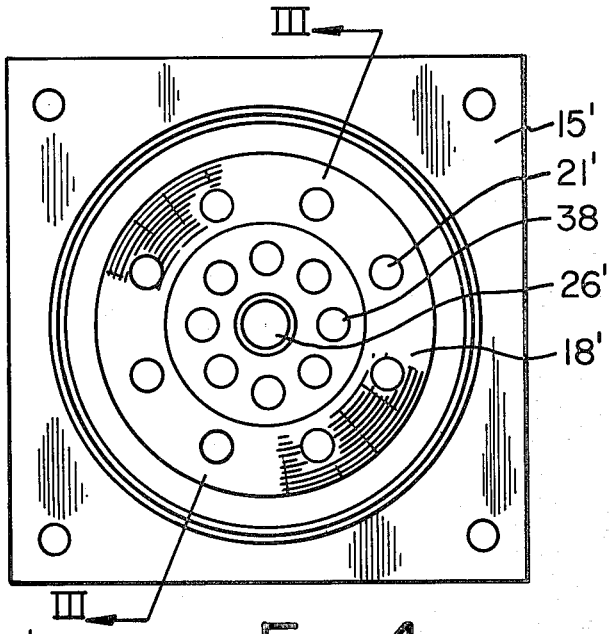
FIG. 4 is an end view of the modified form of the burner.

*The remaining 8,000 SCFH was introduced through an axial set of apertures surrounding the fuel inlet (FIGS. 3 and 4).

At 100% axial flow (FIG. 6I) the flame length increased to 6½' with a 10" diameter increasing to an 18" diameter near the end of the flame. The flame had a long white center portion with a blue ring at the port exit and orange tails at the flame end. Whereas the port was hot in the other tests, in this test the port was streaked with both hot and cold areas.

The ratio of the diameter (D) of the port block to the length (L) of the port block is also important to provide the desired adjustable flame characteristics. I have found that ratio of diameter to length should be in the range of 0.7 to 1.5. The various apertures should have an axial length of some 2 to 2½ times greater than the diameter of the aperture to assure proper flow along the center line of the aperture.

Figure 5:
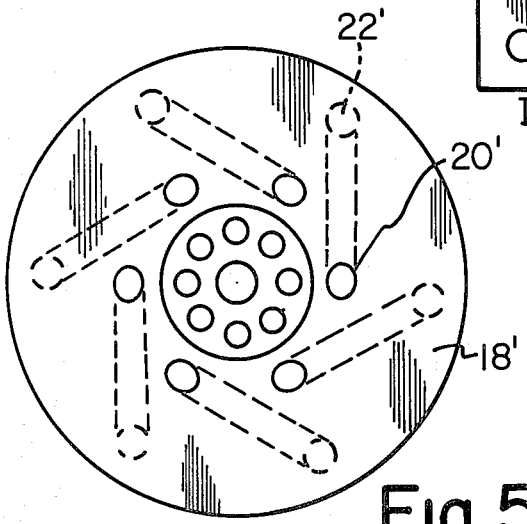
FIG. 5 is an end view of the portion of the burner of FIGS. 3 and 4 showing the spin passageways in phantom.

A modified form of the invention is illustrated in FIGS. 3 through 5. This embodiment is similar to the earlier embodiment in that a burner body 14' terminates in a forward wall defined by baffle 16'. A pair of air chambers 28' and 30' communicate with passages 20' and 22' respectively, which pass through the baffle 16' and converge at the discharge face 18' at an acute angle with one another and offset from a plane through the burner center line. A central fuel duct 26' extends along the burner longitudinal axis as in the earlier embodiment. The only difference in this embodiment is that an additional air chamber 36 is formed annularly about central fuel duct 26' in communication with axial air passageways 38 which extend through the baffle 16' and exit in an inner firing port 40 formed by baffle 16'. Inner firing port 40 is upstream of the intersection between air passages 20' and 22'.

The burner functionally performs as the burner illustrated in FIGS. 1 and 2 throughout the normal operational envelope. However, it has the additional feature of being a maintained energy burner so that when the air flows below 33%, the air passages 38 will utilize the available system pressure for mixing, thereby increasing the combustion intensity.

In both embodiments, the desired flame characteristics can be obtained since the burner is adjustable between the steep rotational spin angle generated by the air through the inclined passages to the pure axial compartment achieved by passing all the air through the passageways extending parallel to the burner longitudinal axis.

I claim:

1. An adjustable flame burner for an industrial furnace comprising:

a burner body having a central longitudinal axis and a baffle with a discharge face forming a forward wall of the burner body;

a first set of a plurality of spaced combustion sustaining gas apertures extending from a first air chamber through the baffle and positioned in a circular plane radially outward from and extending substantially parallel with said burner body axis;

a second set of a plurality of radially spaced combustion sustaining gas apertures extending from a second air chamber axially through the baffle at acute angles to the apertures of the first set and skewed with respect to an imaginary plane passing through said burner body axis, said apertures of the second set intersecting with the apertures of the first set at or substantially adjacent the discharge face; and a fuel duct extending from a fuel source along said central axis and through the baffle terminating upstream of the intersection of the first and second set of apertures.

2. The burner of claim 1, including control means to adjust the relative amount of combustion sustaining gas through the first and second set of apertures.

3. The burner of claim 2, said discharge face being substantially frustoconical and increasing in diameter in a downstream direction.

4. The burner of claim 3, including a third set of a plurality of combustion gas sustaining apertures, said third set extending from a third air chamber axially through the baffle radially outward of the fuel duct and exiting upstream of said intersection.

5. The burner of claim 1, said acute angle being in the range of 45° to 65°.

6. The burner of claim 5, said angle being substantially 65°.

7. In combination a burner and a refractory port block, said burner comprising a burner body having a baffle with a frustoconical discharge face and forming a forward wall of the burner body and aligned with the port block, a fuel duct extending along the burner longitudinal axis and discharging at the discharge face, a first set of air passages extending axially through the baffle radially outward of and exiting downstream of the fuel duct, a second set of air passages extending axially through the baffle at an angle between 45° and 65° to the first set so as to intersect with the first set at substantially the discharge face and upstream of the port block, said second set also being offset from a burner central axis, a pair of air chambers each communicating with one of the first and second set of air passages respectively, control means for varying the air input of the two sets whereby the flame characteristics can be varied between a short high swirl flame and a high intense all radial long flame.

8. The combination of claim 7 wherein said port block has length to diameter of at least 0.7.

9. The combination of claim 8 wherein the port block has a length to diameter in the range of 0.7 to 1.5.

10. The combination of claim 5 wherein the burner includes a third set of air passages, said third set communicating between a separate air chamber and the discharge face and exiting upstream of the intersection between the first and second set of air passages.

* * * * *